US008485614B2

(12) United States Patent
Golias, Jr. et al.

(10) Patent No.: US 8,485,614 B2
(45) Date of Patent: Jul. 16, 2013

(54) BASE STAND WITH DRAWER

(75) Inventors: Bernard J. Golias, Jr., Twinsburg, OH (US); Gary W. James, Parma Heights, OH (US); Gary R. Kish, Parma, OH (US)

(73) Assignee: Metal Fabricating Corporation, Cleveland, OH (US)

( * ) Notice: Subject to any disclaimer, the term of this patent is extended or adjusted under 35 U.S.C. 154(b) by 296 days.

(21) Appl. No.: 12/914,191

(22) Filed: Oct. 28, 2010

(65) Prior Publication Data

US 2011/0148264 A1 Jun. 23, 2011

Related U.S. Application Data

(60) Provisional application No. 61/256,098, filed on Oct. 29, 2009.

(51) Int. Cl.
*F16B 12/00* (2006.01)

(52) U.S. Cl.
USPC ..... 312/111; 312/198

(58) Field of Classification Search
USPC ..... 312/198, 107, 108, 111, 278, 279, 312/330.1; 248/678, 188.1, 346.01
See application file for complete search history.

(56) References Cited

U.S. PATENT DOCUMENTS

| | | | | | |
|---|---|---|---|---|---|
| 1,010,801 | A | * | 12/1911 | Rapp | 206/511 |
| 1,812,694 | A | * | 6/1931 | Hallowell et al. | 312/281 |
| 1,869,649 | A | * | 8/1932 | Atkinson | 219/395 |
| 2,022,591 | A | * | 11/1935 | Everitt | 312/229 |
| 2,103,552 | A | * | 12/1937 | Radyx | 312/235.3 |
| 2,380,379 | A | * | 7/1945 | Attwood | 248/163.1 |
| 2,526,767 | A | * | 10/1950 | Parker | 312/235.5 |
| 2,772,130 | A | * | 11/1956 | Pritchard | 108/9 |
| 2,943,243 | A | * | 6/1960 | Rachman et al. | 361/600 |
| 3,969,006 | A | * | 7/1976 | Brown | 312/234.1 |
| 4,056,295 | A | * | 11/1977 | Downing | 312/107 |
| 4,454,732 | A | * | 6/1984 | Burkland et al. | 68/3 R |
| 6,032,912 | A | | 3/2000 | Korn et al. | |
| 7,306,300 | B2 | | 12/2007 | Kish et al. | |
| 7,641,294 | B1 | * | 1/2010 | Goldberg | 312/196 |
| 7,712,493 | B2 | * | 5/2010 | Carter | 144/286.1 |
| D632,900 | S | * | 2/2011 | Goldberg | D6/420 |
| 2009/0236956 | A1 | * | 9/2009 | Carter | 312/258 |

FOREIGN PATENT DOCUMENTS

JP 05293020 * 11/1993

* cited by examiner

*Primary Examiner* — Janet M Wilkens
(74) *Attorney, Agent, or Firm* — Fay Sharpe LLP; James E. Scarbrough

(57) ABSTRACT

A base stand for supporting a metal cabinet includes a main body having a top wall and four side walls extending therefrom; and legs attached to each of the four side walls of the body. Each of the legs has at least one pair of holes for mounting the legs to the body. A slidable drawer is slidably mounted to the body. A base stand and metal storage bin assembly includes a base stand and metal storage bin assembly including a metal storage bin having a top wall, a bottom wall, and first and second opposed side walls and a base stand for storing and transporting the metal cabinet. The base stand has a main body having a top wall and four side walls extending therefrom and legs attached to the four side walls of the body. Each of the legs has at least one pair of holes for mounting the legs to the body. A slidable drawer is slidably mounted to the body.

21 Claims, 8 Drawing Sheets

BASE STAND WITH DRAWER

CLAIM OF PRIORITY

This application claims priority to Provisional Patent Application Ser. No. 61/256,098, filed on Oct. 29, 2009, which is hereby incorporated by reference.

BACKGROUND OF THE DISCLOSURE

The present disclosure relates generally to units for storage. More particularly, the disclosure relates to a base stand with a slidable drawer used to store, move and transport metal compartment bins.

Metal compartment bins and cabinets are some of the most versatile pieces of furniture available. The cabinets can be hung in work areas such as metal or woodworking shops, garages, as well as many other places. Cabinets and compartment bins can also provide storage in vehicles such as trucks and vans. Metal cabinets also provide versatility in what they store. For example, metal cabinets and compartment bins have been used to store threaded rod, wire, brake line, welding rods, as well as more common items such as tools and fasteners.

Stacking of one cabinet on top of another can be very difficult and impractical without providing some support for the bottom of the metal cabinet.

Accordingly, it is desired to provide a base stand for supporting, lifting and transporting metal cabinets or storage bins which overcomes the above-mentioned difficulties and others while providing improved overall results. It is also desirable to provide a base stand including a slidable drawer for providing further storage for items such as threaded rods, wire, brake lines, welding rods, as well as tools and fasteners.

SUMMARY OF THE DISCLOSURE

In accordance with one aspect of the disclosure, a base stand for supporting a metal cabinet includes a main body having a top wall and four side walls extending therefrom; legs attached to the four side walls of the body; wherein each of the legs has at least a pair of holes for mounting the legs to the body; and a slidable drawer which is slidably mounted to the body.

In accordance with another aspect of the disclosure, a base stand and metal storage bin assembly includes a metal storage bin having a top wall, a bottom wall, and first and second opposed side walls; a base stand for storing and transporting the metal cabinet, including a main body having a top wall and four side walls extending therefrom; legs attached to the four side walls of the body; wherein each of the legs has at least one pair of holes for mounting the legs to the body; and a slidable drawer which is slidably mounted to the body.

According to another aspect of the disclosure, the base stand includes a main body and four legs attached to four sides of the body. The legs extend from each of four corners of the base stand. A metal cabinet or bin is placed on a top surface of the base stand. Each leg extends slightly above each base stand side wall at each corner to provide rigidity and support to the bin. Also, the legs help prevent swaying of the bin or shifting of the bin from side to side on the base stand. At an upper edge of each leg at least two holes are drilled on each wall of the legs to secure each of the legs to the base stand. Corresponding holes are drilled through the base stand main body. Each leg has a lip or wall extending from each of the leg side walls to provide additional support to the metal bin.

The base stand main body includes an upper wall and four side walls extending downwardly therefrom. A bottom wall may also be provided as part of the base stand. The base stand can be formed of one sheet of metal wherein the side walls are bent downwardly from the top. Alternatively, the base stand can be made of separate sheets of metal welded together. Four holes are formed on each of the side walls of the stand to attach the legs to the stand walls via suitable fasteners.

A substantially rectangular opening is formed in a front wall of the stand. The opening receives a slidable drawer. The opening is shown as rectangular, but could also be square or other configurations without departing from the scope of the present invention. The drawer is slid into the opening and mounted to sliding racks mounted to walls attached to opposite sides of the base stand.

Still another aspect of the disclosure is a base stand with legs which provide lateral support to a metal bin or cabinet while being moved or transported.

Another aspect of the disclosure is a base stand with legs which form lips which provide additional lateral support to the metal bin or cabinet.

Another aspect of the disclosure is a slidable drawer which is slidably received between the legs of the base stand.

Still another aspect of the disclosure is legs with notches formed therein to compensate for uneven support surfaces.

Still other aspects of the disclosure will become apparent upon a reading and understanding of the following detailed description.

BRIEF DESCRIPTION OF THE FIGURES

The disclosure takes form in certain parts and arrangements of parts, preferred embodiments of which will be described in detail in this specification and illustrated in the accompanying figures which form a part hereof and wherein.

DETAILED DESCRIPTION OF THE DISCLOSURE

Referring now to the Figures, the showings are for purposes of illustrating the preferred embodiments of the invention only and are not for purposes of limiting same. Directional terms such as “left,” “right,” “front,” “rear,” “top,” and "bottom" and the like will be used to simplify the description of the Figures only and should not be construed as limiting the components to those directional terms.

Figure 1:
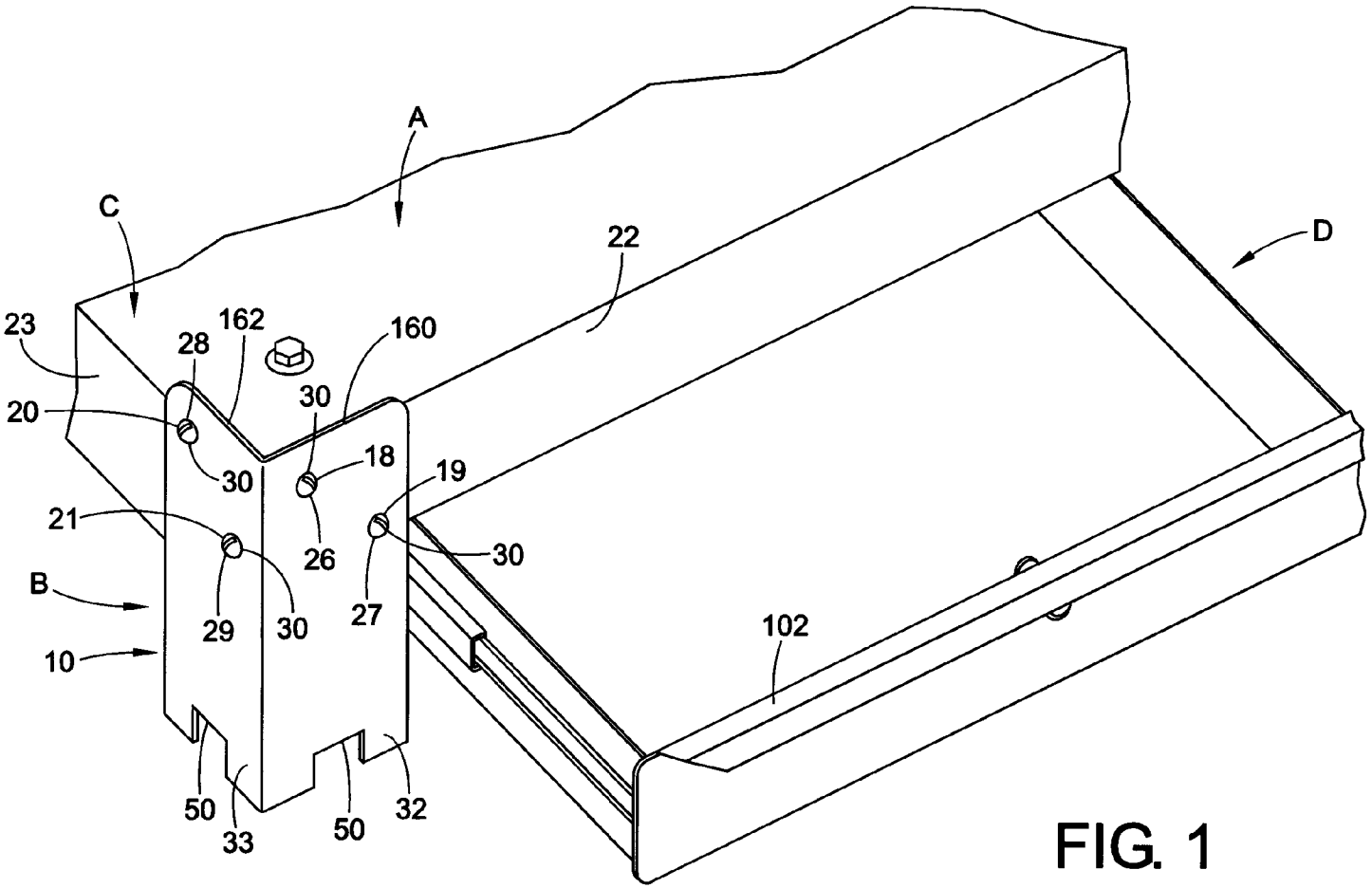
FIG. 1 is a partial top plan view of a base stand with a slidable drawer installed therein in an opened position according to the present invention.

The present disclosure relates to a base stand for transporting metal storage containers. More particularly, referring to FIG. 1, it relates to a base stand A for lifting or transporting or storing a metal container on a conventional fork lift (not shown). A bin of up to 200 pounds or so in weight may be supported on an upper portion of the base stand. The base stand also allows metal containers or cabinets to be stacked during storage or in transportation. That is, another or second base stand with a bin attached thereto is stacked directly on top of a first bin and base stand assembly.

Figure 2:
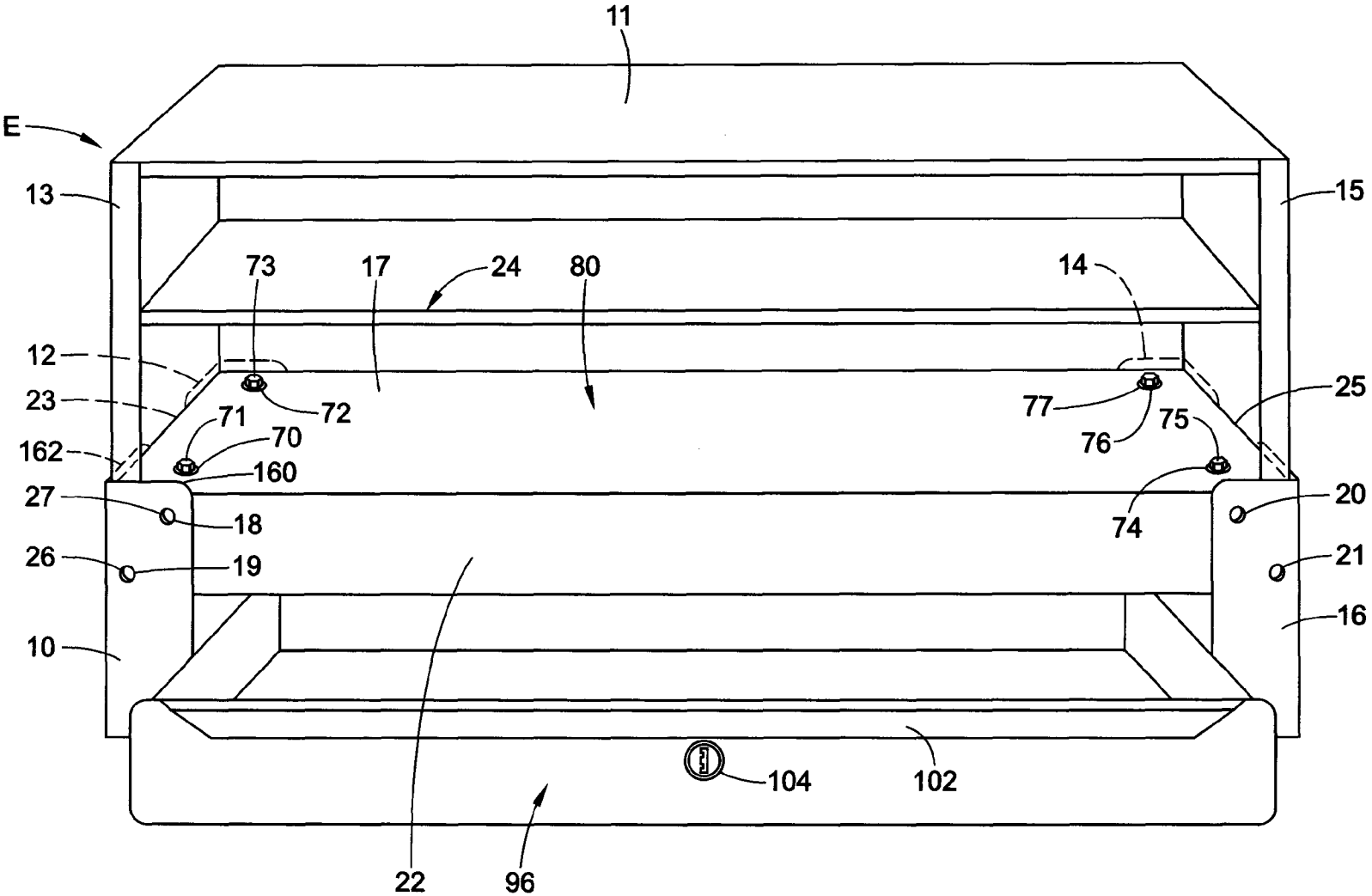
FIG. 2 is a front perspective view of the base stand of FIG. 1 with a metal storage bin mounted on top of the base stand.
Figure 2A:
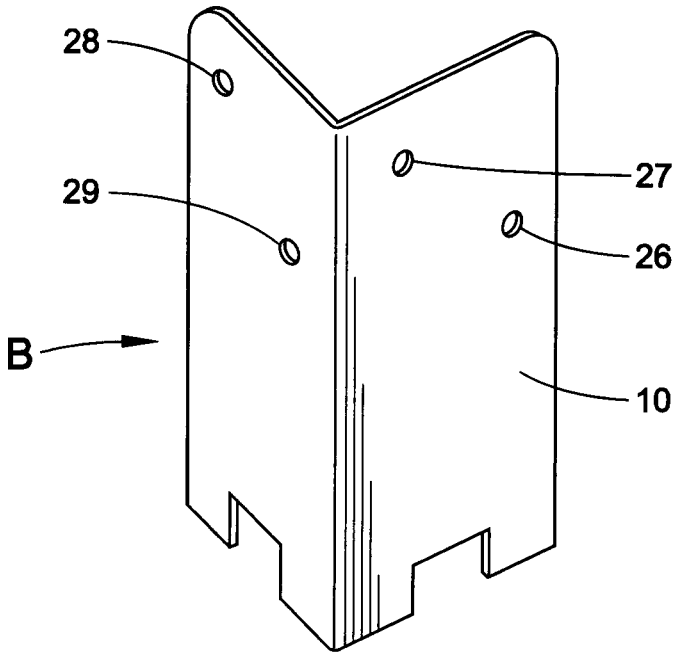
FIG. 2A is a perspective view of a leg of FIG. 2.
Figure 3:
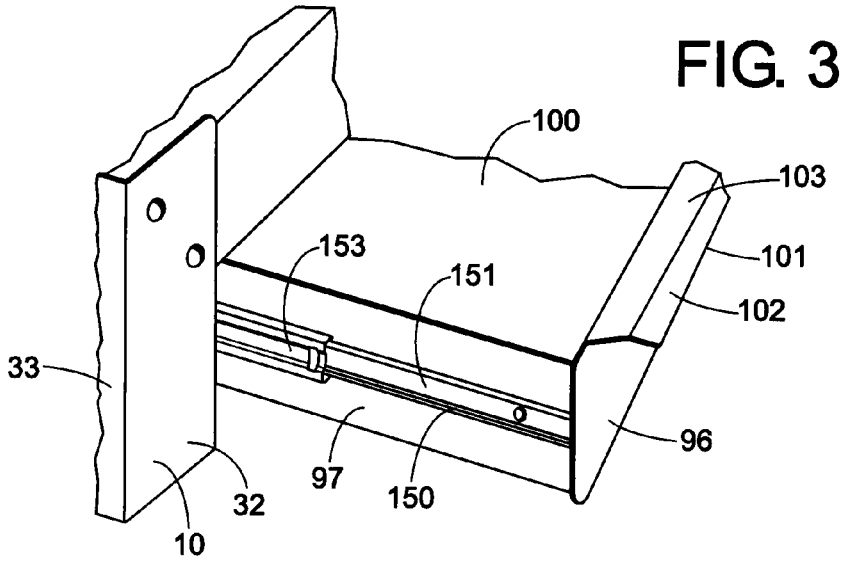
FIG. 3 is a side perspective view of the base stand of FIG. 1 showing the drawer in an opened position.
Figure 4:
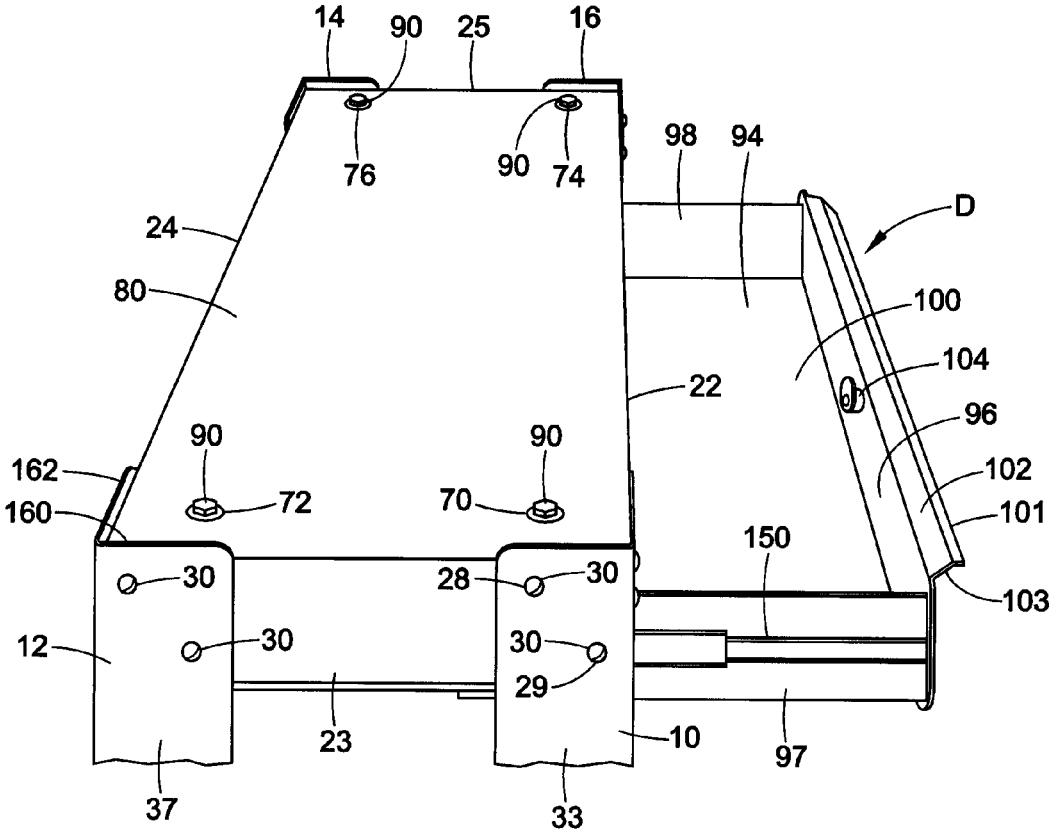
FIG. 4 is a side perspective view of the drawer of the base stand of FIG. 1.

Referring now to FIGS. 2 and 2A, the base stand A includes four one-piece angled (preferably at 90 degrees) legs B which are mounted on opposite sides of the base stand main body C. Four holes 18, 19, 20, 21 are provided at opposite sides of each side wall 22, 23, 24, 25 of the base, and corresponding holes 26, 27, 28, 29 are provided on upper portions of each leg 10, 12, 14, 16 to secure each leg to corresponding side walls 22, 23, 24, 25 of the base stand main body C. Sets of four holes are shown, but other configurations and numbers of holes can be used without departing from the scope of the invention. Suitable fasteners 30 such as screws or bolts are used to secure the legs to the base stand main body by aligning holes 18-21 with holes 26-29. The fasteners may be screwed, welded or otherwise secured into place. The legs help to reinforce supporting of the metal cabinet or bin which can be placed on an upper portion of the base stand.

Figure 6:
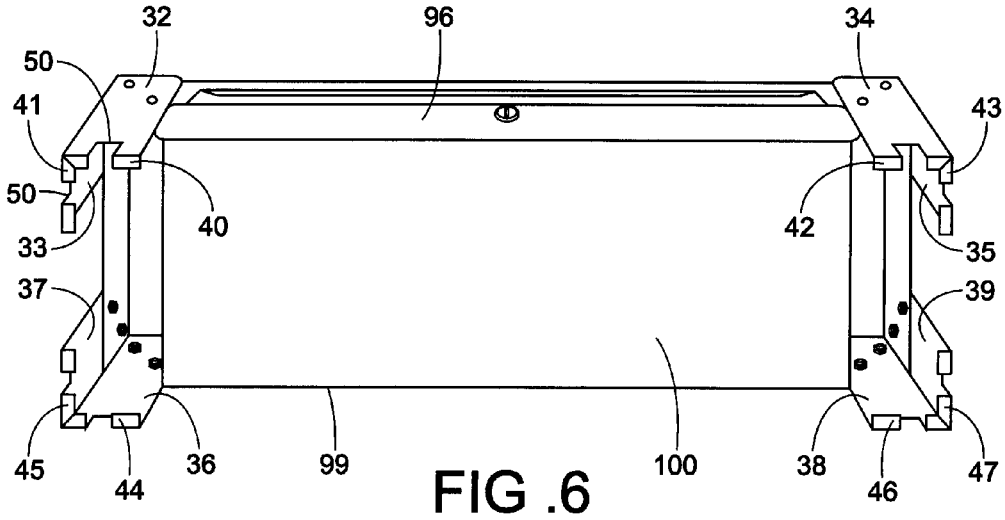
FIG. 6 is a bottom perspective view of the base stand of FIG. 5.

Referring now to FIG. 6, each leg B has a first side wall 32, 34, 36, 38, and a second side wall 33, 35, 37, 39 with an angle (of about 90 degrees) formed between the side walls. The side walls of the legs are formed and bent at a substantially 90-degree angle with respect to each other. However, other angles are also contemplated by the disclosure.

A notch 50 (FIG. 1) may be formed in a lower portion of each leg wall to account for variations in floor surfaces on which the base stand is placed. The notch may have a square shape cutout conformation, but other configurations are contemplated by the disclosure. At a bottom of each leg, two walls or lips 40, 41, 42, 43, 44, 45, 46, 47 are formed by bending a bottom portion of the side walls of the legs at a 90 degree angle with respect to side walls 32, 34, 36, 38 and 33, 35, 37, 39. These walls 40, 41, 42, 43, 44, 45, 46, 47 serve as the bottom support portion of the stand and aid in stabilizing the stand on a support surface. Notches may also be made in these walls as well.

Figure 8:
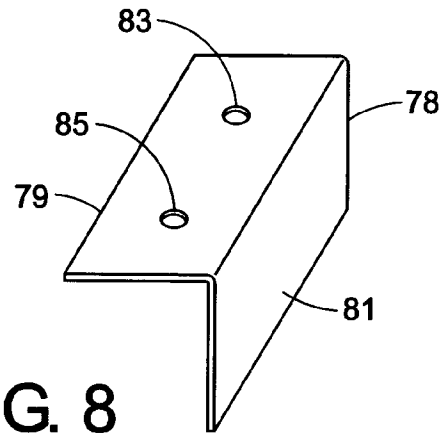
FIG. 8 is a perspective view of a rail support wall.

Additional holes 70, 72, 74, 76 (FIG. 2) are formed on opposite ends of upper wall 80 of the base stand to facilitate securing rail support walls 78 (FIG. 8) to an underside of the upper wall 80. The rail support walls are bent at 90 degrees with a first wall portion 79 parallel to an underside of the upper wall and a second wall portion 81 parallel with opposed side walls 23, 25. Holes 83, 85 are formed in the first walls 79 which align with holes 70-76 to mount the rail support walls to the stand via fasteners 90. A first rail support wall is mounted adjacent an underside of wall 80 and side wall 23. A second rail support wall is mounted adjacent an underside of wall 80 and side wall 25. Holes 70, 72, 74, 76 are also used to secure a metal storage bin E (FIG. 2) having a top wall 11, side walls 13, 15, and bottom wall 17 to the upper wall 80 of the stand. Corresponding holes 71, 73, 75, 77 are formed in the underside of the bin and fasteners are provided to secure the bin to the stand.

The rail support walls include the slidable rail runners 92 (FIGS. 9, 10, 11) which are similar to those described in Metal Fabricating Corporation's U.S. Pat. No. 7,306,300, which is hereby incorporated by reference. Rail runners 92 are mounted to walls 81 of the rail support walls as shown in FIG. 11. Retaining flanges 102, 104 each extend substantially perpendicular from a main wall 106. Flanges 102, 104 are substantially parallel to each other. Flange 104 has a substantially L-shaped configuration. As best seen in FIG. 11, flange 104 has a first leg 108 extending substantially perpendicular from the main wall 106 and a second leg 120 disposed in a spaced relationship from the main wall. Second leg 120 extends from and is substantially perpendicular to first leg 108 and is parallel to the main wall.

Figure 9:
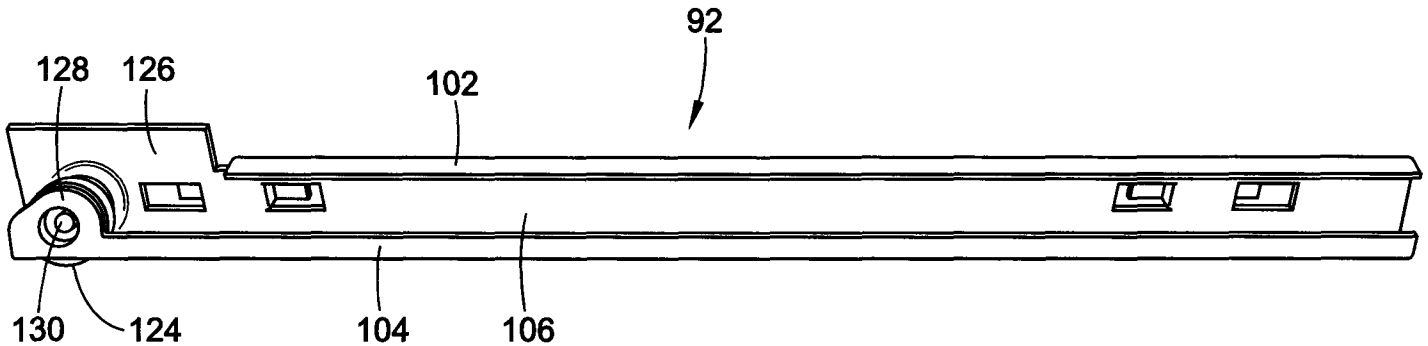
FIG. 9 is a perspective view of an inner side of a cabinet runner side wall extension in accordance with the preferred embodiment of the present invention.

Referring to FIG. 9, a wheel 124 is positioned proximal a rear end 126 of rail runner 92 which is positioned adjacent a rear portion of the base stand. Wheel 124 is interposed between wall 106 and a retaining wall 128 extending from flange 104. The wheel 124 has a fastening means, such as a rivet 130, through its central axis which is attached to the retaining wall and the main wall. As can be best seen in FIG. 10, the second retaining flange 104 has an opening 132 through which a portion of the wheel 124 extends.

Figure 10:
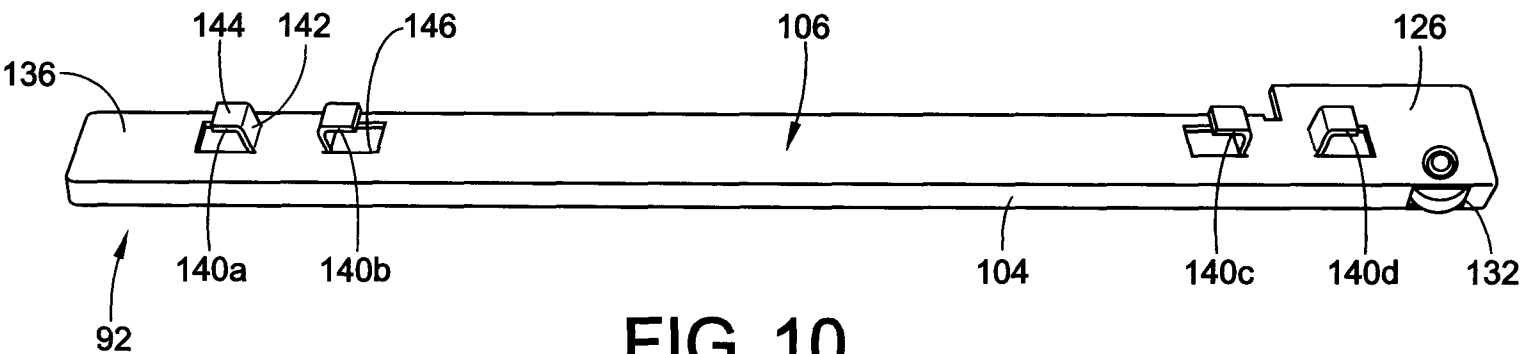
FIG. 10 is a perspective view of an outer side of the cabinet runner side wall extension of FIG. 9; and, FIG. 11 is a side elevational end view of the cabinet runner side wall extension of FIG. 9.
Figure 11:
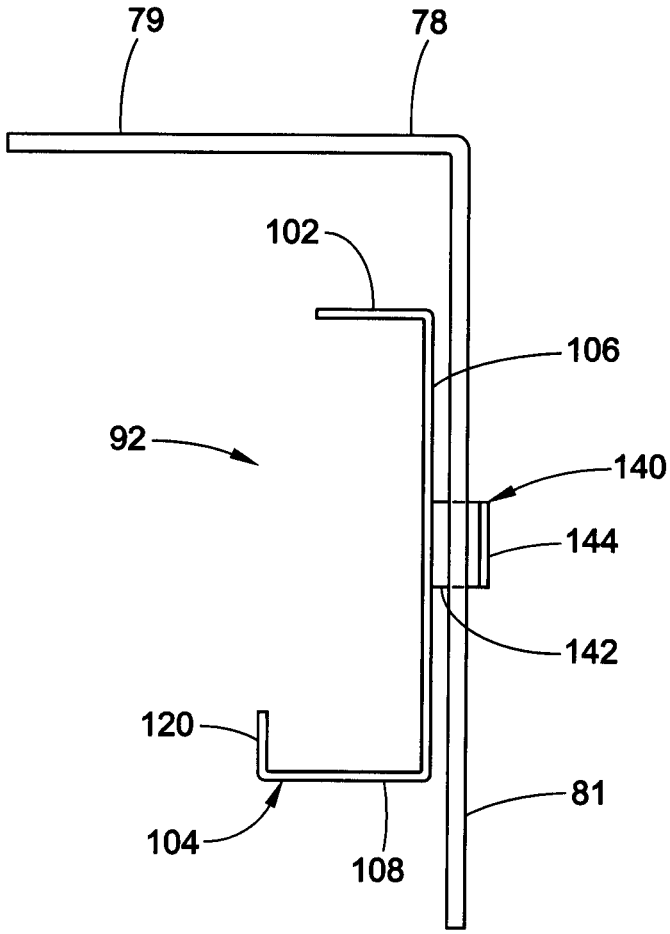

Referring to FIG. 10, the rail runner 92 also includes a front end 136 which is positioned adjacent a front portion of the base stand. Substantially L-shaped tabs 140 protrude from the main wall 106. In the embodiment shown, rail runner 92 includes four tabs 140*a*, 140*b*, 140*c*, and 140*d*. It should be recognized that other numbers of tabs may be used with the rail. Each tab 140 includes a first leg 142 that extends from and is substantially perpendicular to wall 106 and a second leg 144 that extends from and is substantially perpendicular to leg 142 and is substantially parallel to and spaced from wall 106. The first leg 142 can extend at other angles than perpendicular from the wall 106 without departing from the scope of the present disclosure. The tabs 140 may be punched out of the main wall 106 thus leaving an opening 146 which was previously filled with the material of the tab. Alternatively, the tabs 140 could be a separate piece of metal or plastic and welded onto the rail 92. For example, second leg 144 of the tab can be fastened to a base stand sidewall via welding or other suitable means. The gap formed between leg 144 and wall 106 provides a space so that slidable shelf or drawer is properly mounted and spaced from the base stand side wall.

Referring to FIG. 11, retaining flanges 102, 104 and leg 120 form a channel to receive a drawer slide assembly 150. Leg 144 is spaced from wall 106 so that a drawer will fit flush with the front edge of the base stand and thus eliminating a separate spacer.

Figure 5:
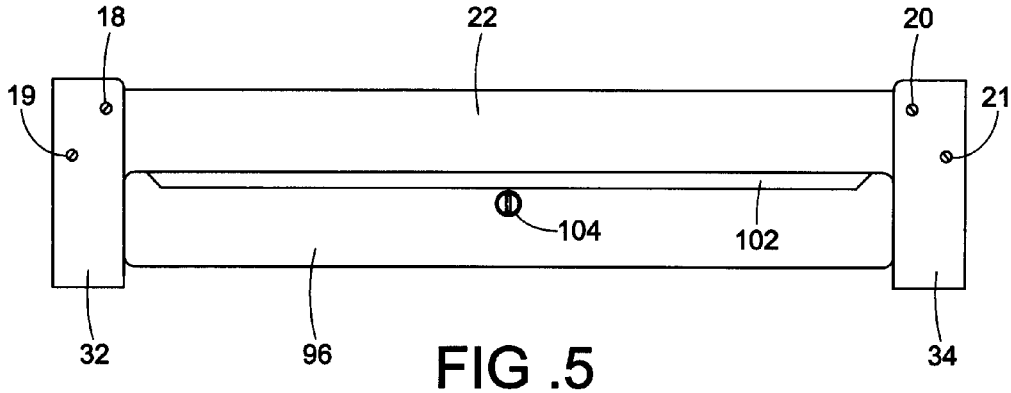
FIG. 5 is a front elevational view of the base stand of FIG. 1 with the drawer in a closed position.
Figure 7:
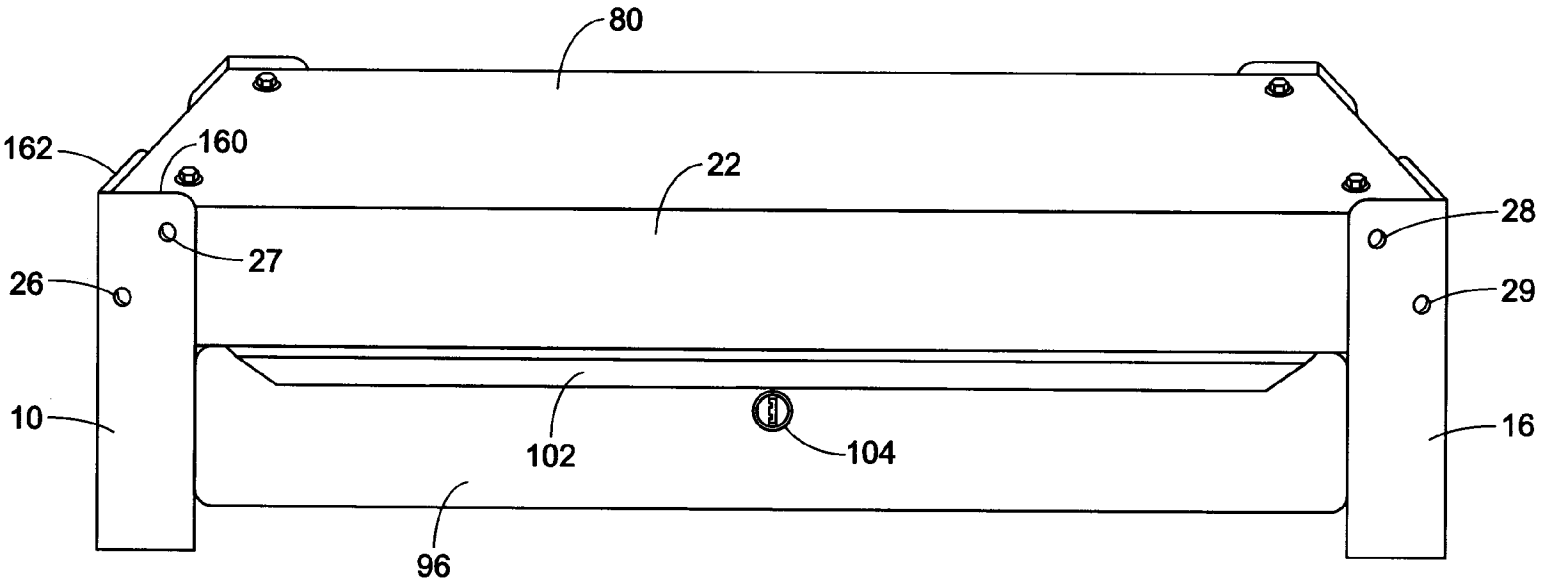
FIG. 7 is a front perspective view of the base stand of FIG. 5.

The rail runners described above are mounted to walls 81 and slidably receive telescoping rail assembly 150, 151, 153 mounted to slidable drawer D which has a body 94 having an elongated front wall 96 (FIG. 5, FIG. 7), parallel side walls 97, 98 and an elongated rear wall 99 parallel to front wall 96 and a bottom wall 100 extending between front wall 96, side walls 97, 98 and rear wall 99 (FIG. 6). The front wall has a lip or angled ledge 102 having a first wall 101 and a second wall 103 formed at an angle (of greater than 90 degrees) to the first wall 101 to facilitate pulling the drawer out of the stand, as well as removing objects from the drawer. A conventional lock 104 is provided on front wall 96 of the drawer to lock the drawer within the base stand.

As seen in FIGS. 1, 2, 4 and 7, when installed, upper edges 160, 162 of the legs extend above a top edge of the base stand to form a lip to provide additional support for the metal bin.

The base stand may be formed of a single sheet of metal which is bent into the configuration shown, or it may be formed of separate pieces of metal which are secured or welded together. The base stand drawer can slide between an open position (FIG. 1) and a closed position (FIG. 5) and may be locked in the closed position.

The exemplary embodiments have been described with reference to the preferred embodiments. Obviously, modifications and alterations will occur to others upon reading and understanding the preceding detailed description. It is intended that the exemplary embodiment be construed as including all such modifications and alterations.

The invention claimed is:

1. A base stand for supporting a metal cabinet, comprising:

a main body having a top wall and first, second, third, and fourth side walls extending therefrom;

legs attached to each of said first, second, third, and fourth side walls of said body;

wherein each of said legs has at least one pair of holes for mounting said leas to said body;

and a slidable drawer which is slidably mounted to said body; wherein each of said legs extends above an upper surface of said top wall of said main body.

2. The base stand of claim 1, wherein each of said first, second, third, and fourth side walls of said main body include at least one pair of holes which correspond to said at least one pair of holes of said legs.

3. The base stand of claim 1, wherein said at least one pair of holes of each leg is aligned with said at least one pair of holes of said first, second, third, and fourth side walls of said main body and fasteners are inserted through aligned pairs of holes to secure each of said legs to corresponding side walls.

4. The base stand of claim 1, wherein each of said legs comprises a first wall and a second wall at an angle of about 90 degrees with respect to said first wall.

5. The base stand of claim 4, wherein each of said legs comprises a third wall formed at an end of said first wall and a fourth wall formed at an end of said second wall.

6. The base stand of claim 5, wherein said third wall is formed at an angle of about 90 degrees with respect to said first wall and said fourth wall is formed at an angle of about 90 degrees with respect to said second wall.

7. The base stand of claim 4, wherein at least two of said first, second, third, and fourth side walls of said main body comprise a notch formed adjacent an end of one of said first walls and said second walls of said legs.

8. The base stand of claim 1, further comprising rail support walls mounted to an underside of said top wall of said main body.

9. The base stand of claim 8, further comprising slidable rail runners mounted to said rail support walls.

10. The base stand of claim 9, wherein said slidable drawer comprises a front wall and two side walls extending from said front wall.

11. The base stand of claim 10, wherein said two side walls of said drawer each comprise slidable rails slidably received by said slidable rail runners.

12. The base stand of claim 10, wherein said slidable drawer front wall comprises an angled lip for facilitating pulling the drawer.

13. The base stand of claim 1, wherein said top wall of said main body comprises holes for mounting a cabinet onto said base stand.

14. A base stand and metal storage bin assembly comprising:

a metal storage bin having a top wall, a bottom wall, and opposed first and second side walls;

a base stand for storing and transporting said metal storage bin, comprising:

a main body having a top wall and four side walls extending therefrom;

legs attached to said four side walls of said body;

wherein each of said legs has at least one pair of holes for mounting said legs to said body;

and a slidable drawer which is slidably mounted to said body; wherein said bin is mounted to said base stand between said top wall of said main body of said base stand and said legs.

15. The base stand and bin assembly of claim 14, wherein each of said legs comprise first and second walls at an angle of about 90 degrees with respect to each other and wherein at least two of said four side walls of said main body comprise a notch formed adjacent an end of one of said first and second walls of said legs.

16. The base stand and bin assembly of claim 14, further comprising rail support walls mounted to an underside of said top wall of said main body.

17. The base stand and bin assembly of claim 16, further comprising slidable rail runners mounted to said rail support walls.

18. The base stand and bin assembly of claim 17, wherein said slidable drawer comprises a front wall and two side walls extending from said front wall.

19. The base stand and bin assembly of claim 18, wherein said two side walls of said drawer each comprises slidable rails slidably received by said slidable rail runners.

20. The base stand and bin assembly of claim 18, wherein said slidable drawer front wall comprises an angled lip for facilitating pulling the drawer.

21. The base stand and bin assembly of claim 14, wherein said top wall of said main body comprises holes for mounting on cabinet into said base stand.

* * * * *